US005098339A

United States Patent [19]

Dabrowski

[11] Patent Number: 5,098,339

[45] Date of Patent: Mar. 24, 1992

[54] COIN FEEDING DEVICE

[75] Inventor: Stanley P. Dabrowski, Las Vegas, Nev.

[73] Assignee: 7's Unlimited, Inc., Las Vegas, Nev.

[21] Appl. No.: 645,966

[22] Filed: Jan. 23, 1991

[51] Int. Cl.[5] ..... G07D 9/04

[52] U.S. Cl. ..... 453/30; 453/57; 221/203

[58] Field of Search ..... 453/32, 33, 34, 35, 453/40, 49, 57, 30; 221/182, 203, 237; 222/238, 239, 240, 242, 411

[56] References Cited

U.S. PATENT DOCUMENTS

| | | | |
|---|---|---|---|
| Re. 32,799 | 12/1988 | Abe | 453/32 |
| 2,500,698 | 3/1950 | Mills | 222/242 X |
| 3,680,566 | 8/1972 | Tanaka et al. . | |
| 3,942,544 | 3/1976 | Breitenstein . | |
| 4,398,550 | 8/1983 | Shireman . | |
| 4,437,478 | 3/1984 | Abe . | |
| 4,441,515 | 4/1984 | Goepner . | |
| 4,506,811 | 3/1985 | Miksitz | 222/411 |
| 4,531,531 | 7/1985 | Johnson . | |
| 4,534,373 | 8/1985 | Glinka . | |
| 4,557,282 | 12/1985 | Childers . | |
| 4,681,128 | 7/1987 | Ristvedt | 453/6 |
| 4,752,274 | 7/1988 | Abe | 453/32 |
| 4,753,625 | 6/1988 | Okada | 453/32 |
| 4,822,318 | 4/1989 | Okada | 453/57 |
| 4,881,919 | 11/1989 | Dabrowski | 453/57 |

FOREIGN PATENT DOCUMENTS

| | | | |
|---|---|---|---|
| 2185341 | 7/1987 | United Kingdom | 453/49 |

*Primary Examiner*—F. J. Bartuska
*Attorney, Agent, or Firm*—Quirk, Tratos & Roethel

[57] ABSTRACT

The coin dispensing device is adapted to be disposed at the bottom of a vertical coin hopper and receives loose coins to be dispensed from the coin hopper. A first rotating agitator disk withdraws the loose coins from the coin hopper and feeds the coins through a central feed aperture in the first rotating disk. A fixed disk lies below the first rotating disk and has a dispensing slot therein that receives the coins from the central feed aperture. The coins to be dispensed are lined up in a row in the dispensing slot from the center of the fixed disk to the periphery thereof for dispensing through an exit slot in the fixed disk. A second rotating dispensing disk lies below the fixed disk and spring biased pusher balls on the second rotating disk push on the edge of each coin to push coins from the center of the fixed disk down the dispensing slot. The dispensing slot in the fixed disk sits adjacent to a coin tray where the loose coins that have been dispensed are accessible to the patron. The direction of rotation of the first and second rotating disks can be reversed to alleviate any interruption of coin dispensing that may be caused by coins bridging or jamming in the device.

30 Claims, 8 Drawing Sheets

COIN FEEDING DEVICE

This invention relates to a coin dispensing device, and more particularly to a coin dispensing device designed to be used in a compact space, such as in a currency changing machine.

BACKGROUND OF THE INVENTION

There are many coin dispensing devices available that dispense loose coins from a bulk hopper into a tray so that the coins become available to the patron. These coin dispensing devices are used in many different apparatuses such as vending machines, currency changing machines and gaming devices such as slot machines. The coin dispensing device of the present invention can be utilized to feed loose coins from a hopper to a coin tray in any type of apparatus that handles loose coins. The coin dispensing device is also useful for dispensing any objects shaped like coins, for example tokens or disks that may or may not have monetary value.

Currency changing machines have become an indispensable part of the equipment utilized in the gaming, amusement and vending businesses. A patron desiring to obtain loose coins to use in a vending, amusement or gaming machine merely inserts currency into the currency changer and receives the appropriate coinage.

A typical currency changing machine has a currency acceptor/validator that verifies that the currency being inserted is legitimate. There is also a coin storage device, such as a hopper, that holds the supply of loose coins that will be dispensed to the patron. The coin storage device has a mechanical dispensing apparatus that dispensings the coins from the storage area to a coin tray that is accessible by the patron. The currency changer is provided with electronics that controls the operation of the dispensing of the coins to ensure that the appropriate number of coins are supplied to the patron.

Representative of a coin dispensing device that is used in gaming equipment, such as a slot machine, is the device shown in U.S. Pat. No. 3,942,544, to Breitenstein. A bowlshaped hopper is provided on the interior of the gaming machine. Coins inserted by the patron fall into the hopper and become the coin supply to be dispensed in the event that the patron achieves a winning combination on the slot machine. On the back wall of the hopper, there is provided a pin wheel device that rotates through the coin supply and picks up individual coins around the periphery of the pin wheel. As the pinwheel rotates, the coins on the top of the pinwheel are fed along a knife track to a location where each coin exits the interior of the gaming machine and is dispensed into a coin tray for access by the patron. The Breitenstein hopper is susceptible to jamming and is limited in the number of coins it can hold.

There are also devices that receive coins from the bottom of a hopper and typically these designs are used in currency changing machines. These devices utilize rotating disks to receive the coins from the hopper and dispense the coins to the patron. Representative of this type of design is U.S. Pat. No. 4,398,550 to Shireman.

Shireman discloses a pair of rotating, overlapping disks each with a plurality of coin receiving apertures. The disks rotate in opposite angular directions and coins are transferred from one disk to the other disk when the apertures line up. The axes of the disks are offset in that only one aperture in the upper disk lines up with one aperture in the lower disk so that only one coin dispensed at a time. A coin dispensing device that utilizes the Shireman apparatus must be large enough to accommodate the diameters of each of the two overlapping disks.

Representative of another coin dispensing apparatus is the device disclosed in U.S. Pat. No. 4,881,919 to Stanley P. Dabrowski, the inventor of the present invention. This apparatus uses a single rotating disk at the bottom of the hopper. The rotating disk is provided with a plurality of peripheral slot-like passages that receive coins from the hopper and then spin the coins off the disk at a particular angular position so that the coins can be dispensed into a coin tray.

It is important that the coin dispensing device be virtually trouble-free. The coin dispensing device becomes inoperable in the event of coin jams. The coin hopper storage area must be as large as possible so that an adequate supply of loose coins is available to the gaming patron. If the coin dispensing device jams or if the coin dispensing device runs out of loose coins, the gaming or amusement patron will become discouraged and will quit playing the gaming or amusement machine.

It is an object of the present invention to provide a coin dispensing device that is virtually trouble-free and not susceptible to coin jamming because the weight of the coins in the coin hopper storage area is not imposed upon the mechanism that feeds the coins into the coin tray. It is a further object of the present invention that the coin dispensing device is compact and generally no larger than the diameter of the rotating agitator disk so that the coin dispensing device can be used in coin dispensing equipment that is small enough to fit in tight spaces.

It is a feature of the present invention to provide a coin dispensing device that has first rotating agitator disk that withdraws coins from the bottom of the coin hopper, a central aperture that feeds the coins to a dispensing slot in a fixed disk and a second rotating dispensing disk that pushes the coins along a dispensing slot in the fixed disk and into an adjacent coin tray where the coins are accessible by the patron.

It is a further feature of the present invention that the second rotating dispensing disk be provided with one or more pusher balls that are spring biased. As the second rotating disk rotates, each pusher ball in turn comes into contact with the edge of a coin lined up in the dispensing slot. The pusher ball will provide a positive drive to the edge of a coin only up to a certain force which is determined by the strength of the bias spring and the torque of the motor driving the second rotating disk. If the force necessary to push the coin exceeds a certain level (which would occur in the event of a coin jam), the pusher ball will push down on the bias spring and slid underneath the edge of the coin. This will normally occur when a coin in the central feed aperture is oriented at an angle instead of being horizontal in the central feed aperture. In order to correct this situation, the direction of rotation of the first and second rotating disks can be reversed to alleviate any interruption of coin dispensing that may be caused by coins bridging or jamming in the device.

It is an advantage of the present invention that the coin dispensing device takes up very little space and can be used in compactly designed coin changing equipment and that the coin dispensing is virtually jam free and very easy to maintain.

SUMMARY OF THE INVENTION

The coin dispensing device of the present invention is adapted to be disposed at the bottom of a vertical coin hopper and receives loose coins to be dispensed from the coin hopper. A first rotating agitator disk withdraws the loose coins from the coin hopper and feeds the coins through a central feed aperture in the first rotating disk. A fixed disk lies below the first rotating disk and has a dispensing slot therein that receives the coins from the central feed aperture.

The coins to be dispensed are lined up in a row in the dispensing slot from the center of the fixed disk to the periphery thereof for dispensing through an exit slot in the fixed disk. A second rotating dispensing disk lies below the fixed disk and spring biased pusher balls on the second rotating disk push on the edge of each coin to push coins from the center of the fixed disk down the dispensing slot. The dispensing slot in the fixed disk sits adjacent to a coin tray where the loose coins that have been dispensed are accessible to the patron.

The direction of rotation of the first and second rotating disks can be reversed to alleviate any interruption of coin dispensing that may be caused by coins bridging or jamming in the device.

The coin dispensing device of the present invention can be used in any coin handling equipment that dispenses loose coins. Typical units of this type are coin changing machines, vending machines, and gaming equipment, such as slot machines or video poker machines.

DETAILED DESCRIPTION OF THE PREFERRED EMBODIMENTS

Figure 1:
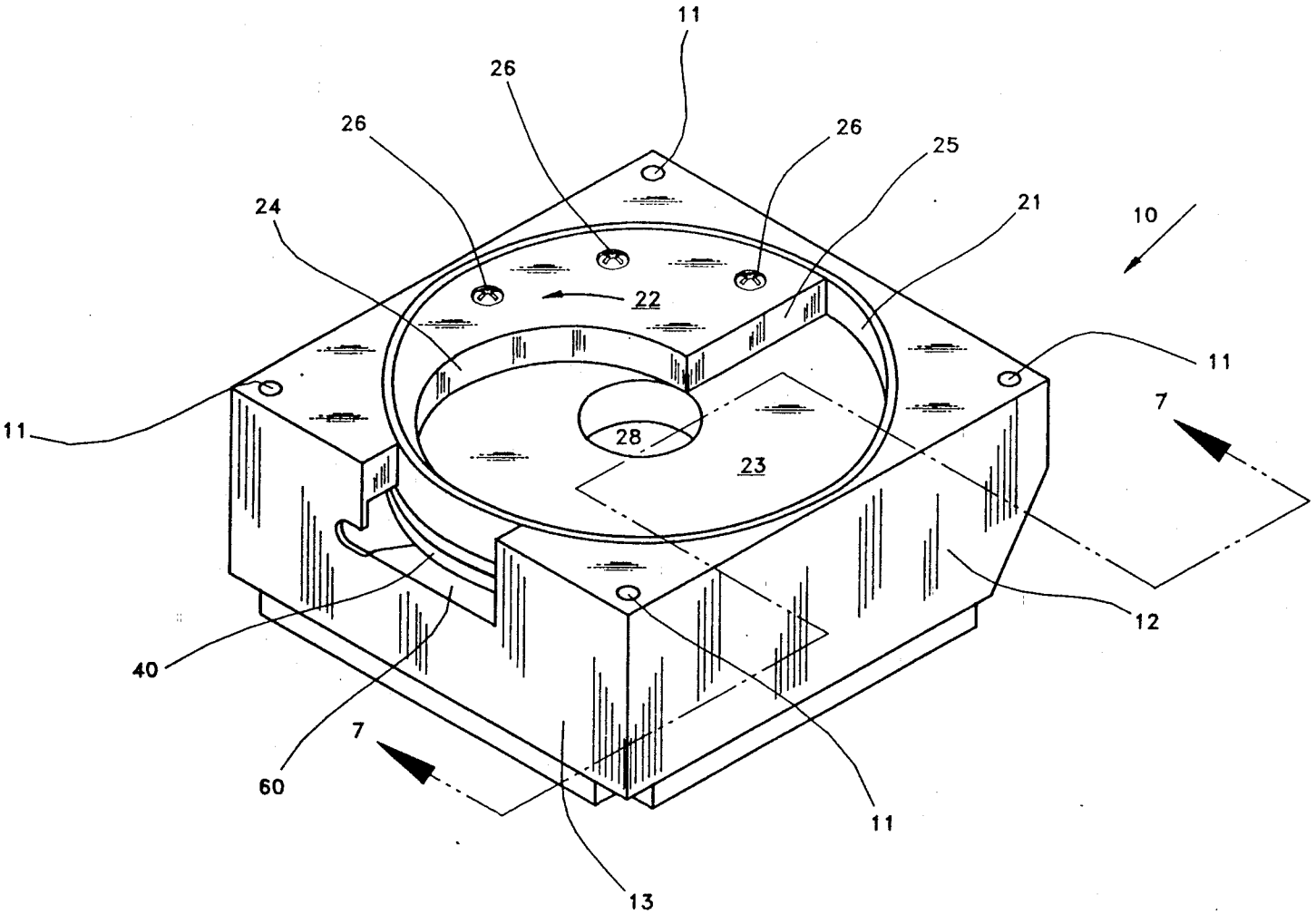
FIG. 1 shows a perspective view of the coin dispensing device of the present invention.
Figure 2:
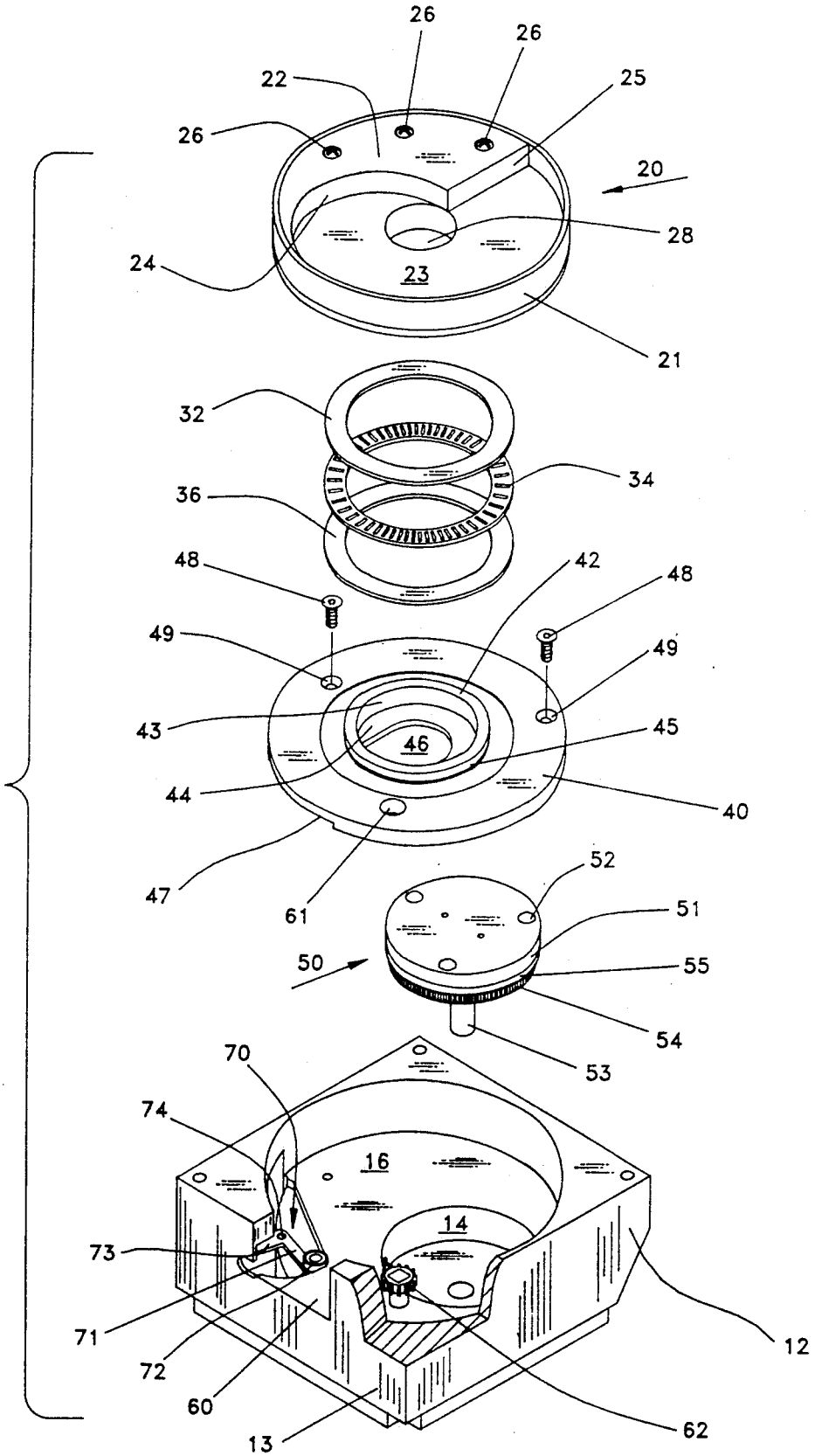
FIG. 2 shows an exploded perspective view of the various elements of the coin dispensing device of the present invention, with a corner of the bottom plate removed to show details of the invention.

The coin dispensing device of the present invention is shown generally at 10 in FIG. 1. Referring to FIGS. 1 and 2, the coin dispensing device 10 includes a base plate 12 which is preferably generally rectangular in shape and has a front side 13. In the center portion of the base plate 12 there is provided an upper cavity 16 which will receive the operating elements of the coin dispensing device 10, including the first rotating agitator disk 20 and the fixed disk 40. A portion of the upper cavity 16 is further provided with a lower cavity that receives the second rotating dispensing disk 50 as will be explained below.

On the upper surface of the base plate 12 at each corner are provided hopper attachment ports 11 to which a coin hopper 90 (shown in phantom in FIG. 3) can be connected. The coin hopper 90 can have any suitable cross-section depending on the overall outside appearance of the coin dispensing device and is open at the bottom so that the interior of the coin hopper 90 is in direct communication with the top of the base plate 12. The coin hopper 90 can be attached to the base plate 12 in any suitable manner such as screws or posts inserted into the hopper attachment ports 11. The coin dispensing device 10 is designed to withdraw loose coins that are stored in the coin hopper 90 directly from the bottom of the coin hopper 90.

In the front side 13 of the base plate 12, an opening is provided which functions as the exit slot 60 for loose coins that are dispensed from the coin dispensing device 10. A coin tray (not shown) is disposed adjacent the exit slot 60 to receive the loose coins exiting the coin dispensing device 10.

Referring now to FIG. 2 in addition to FIG. 1, the operating elements of the coin dispensing device 10 are shown in detail. The operating elements comprise a first rotating agitator disk 20, an upper thrust bearing runner 32, a thrust bearing 34, a lower thrust bearing runner 36, a fixed disk 40 and a second rotating dispensing disk 50 all stacked upon each other and mounted inside the lower cavity 14 and upper cavity 16 of the base plate 12.

The first rotating disk 20 is a generally circular member having a peripheral side wall 21 and a bottom plate 23. In the center of the bottom plate 23 there is a central feed aperture 28, approximately the diameter of a loose coin to be dispensed. A feeding member 22 is attached to the bottom plate 23 by screws 26 or other suitable attaching units. The feeding member 22 has a arcuate sidewall 24, one end of which is tangential to the side wall 21 and the other end of which terminates at the central feed aperture 28. The feeding member 22 also has a flat end wall 25 that extends from the central feed aperture 28 radially to the peripheral side wall 21.

Figure 9:
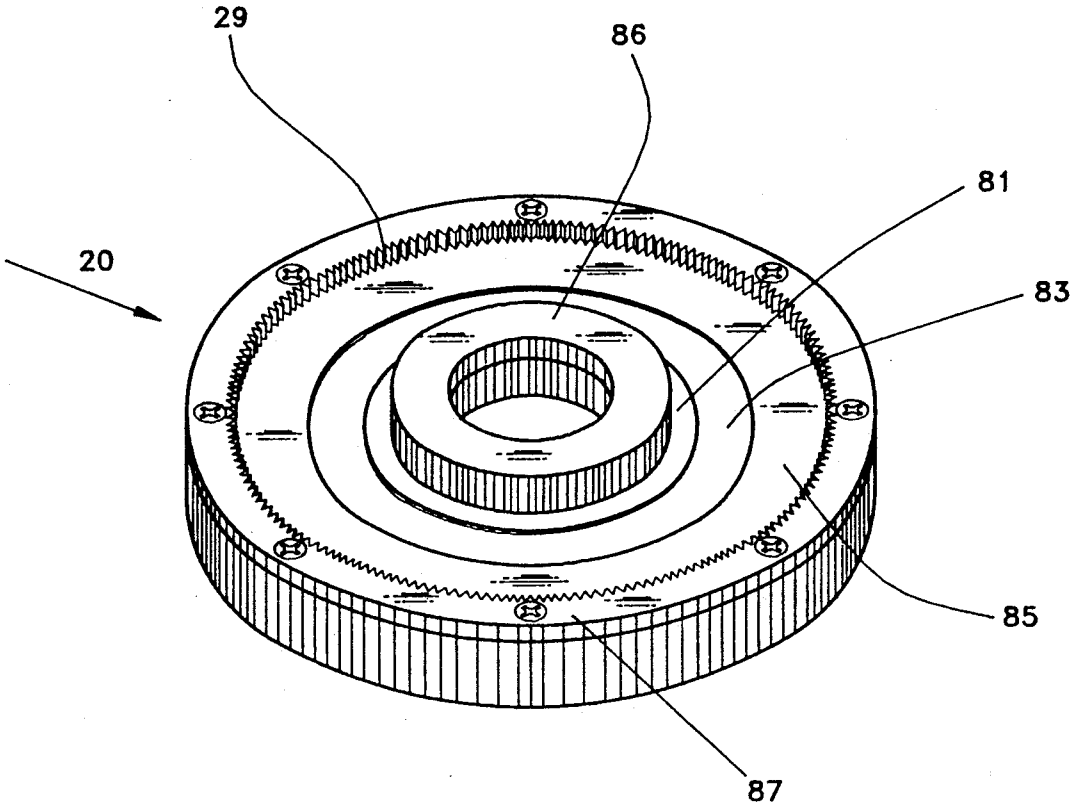
FIG. 9 shows a perspective view of the underside of the first rotaing disk of the present invention.

Referring now to FIG. 9, the underside of the first rotating disk is shown. The underside has an inner plate 81 and an outer plate 85 between which is a recessed area that functions as the thrust bearing channel 83. The center of the under side of the first rotating disk is a lower extension 86 which forms the passage of the central feed aperture 28. On the perimeter of the underside is a gear teeth plate 87 attached by screws. The interior circumference of the gear teeth plate 87 is provied with gear teeth 29.

Disposed underneath the first rotating disk 20 is a fixed disk 40. The fixed disk 40 is a generally circular flat plate member that is attached in a fixed position to the upper disk cavity 16 by means of screws 48 or other suitable attaching devices mounted in the screw apertures 49. The fixed disk 40 also has a mounting post aperture 61 that receives the mounting post 64 on the drive gear shaft 68, as shown more clearly in FIG. 7.

Toward the center of the fixed disk 40, there is provided an axial bearing 42. Around the axial bearing 42 are mounted the upper thrust bearing runner 32, the thrust bearing 34 and the lower thrust bearing runner 36 which are generally circular ring members that accommodate the rotation of the first rotating disk 20 relative to the fixed disk 40 in a manner well known in the art. When the parts are assembled, the upper thrust bearing runner 32, the thrust bearing 34 and the lower thrust bearing runner 36 reside in the thrust bearing channel 83 in the underside of the first rotating disk 20.

The axial bearing 42 includes an axial bearing inner wall 43 that receives the lower extension 86 on the underside of the first rotating disk 20. The axial bearing 42 also includes an axial bearing outer wall 45 that prevents sideways movement of the upper thrust bearing runner 32, the thrust bearing 34 and the lower thrust bearing runner 36. The lower surface of the fixed disk 40 is provided with a dispensing slot plate 44 that extends into the opening in the center of the lower portion of the fixed disk 40 and defines a dispensing slot 46 through which coins to be dispensed will move as will be explained below.

Figure 8:
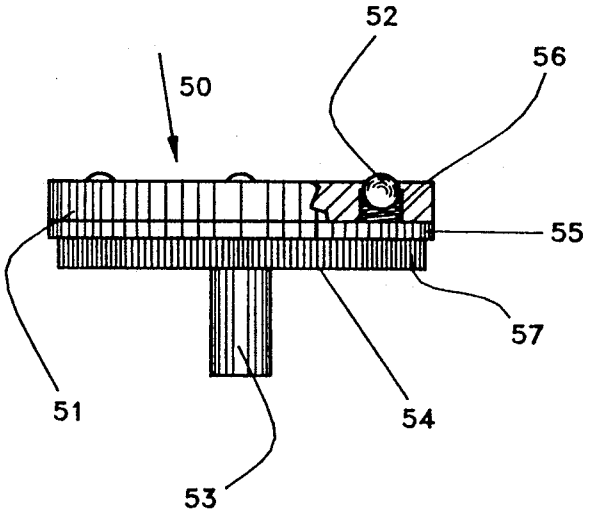
FIG. 8 shows a side view partly in section of the second rotating disk of the present invention.

Underneath the fixed disk 40 is the second rotating dispensing disk 50 which is mounted for rotating movement in the lower disk cavity 14. As shown in FIGS. 2 and 8, the second rotating disk 50 is a generally circular member having an upper plate 51, an intermediate plate 55 and a lower plate 54 which has gear teeth 57 around the periphery thereof. A central disk shaft 53 will effect the rotation of the second rotating disk 50 as will be explained herein.

A plurality of pusher balls 52 are provided at the outer periphery of the top surface of the second rotating disk 50. Each pusher ball 52 is mounted in an aperture in the upper plate 51 and the cross section of the aperture is smaller than the diameter of the pusher ball 52 to keep the pusher ball 52 within the aperture. Each pusher ball 52 is spring biased in an upward direction by spring 56 which is held in place by the intermediate plate 55. The pusher balls 52 are used to push on the outer edges of coins lined up in the dispensing slot 46 when the loose coins are to be dispensed as will be explained below.

Figure 7:
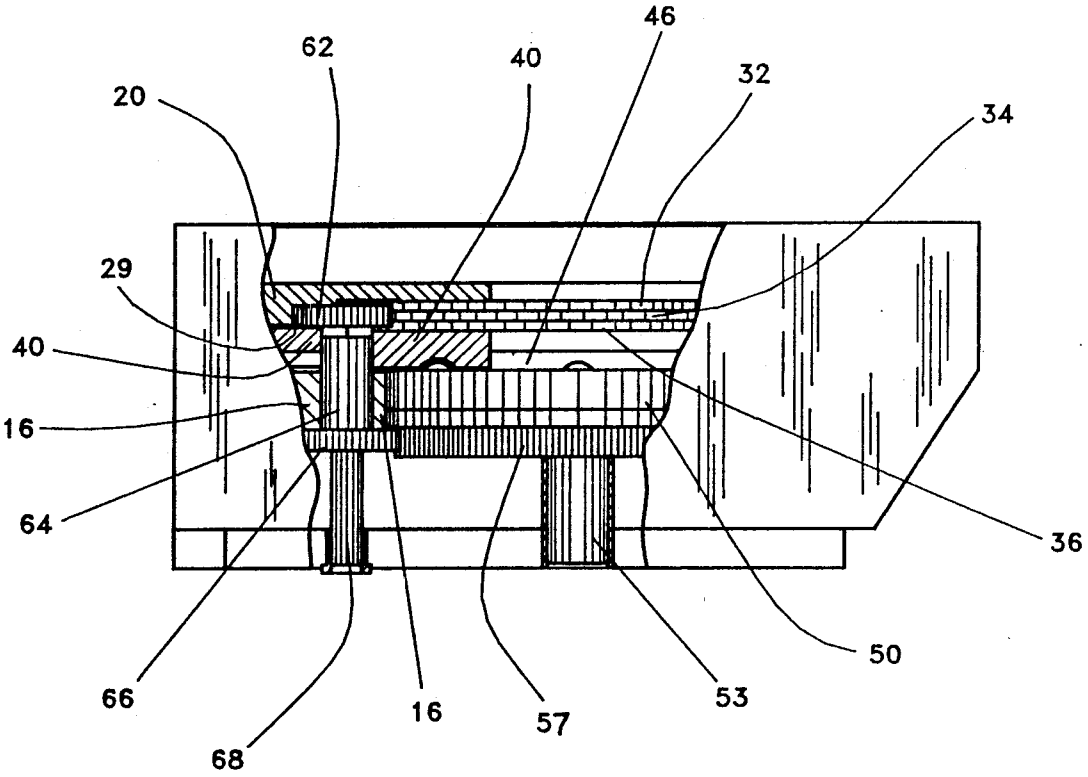
FIG. 7 shows a side view partly in section of the coin dispensing device of the present invention.

As shown in FIGS. 2 and 7, adjacent the exit slot 60 is a coin actuator 70. The coin actuator 70 comprises an outer arm 71 and an inner arm 73 angled at the center and mounted for pivotal movement around a pivot point 74. The coin actuator will pivot each time a loose coin slides through the exit slot 60 and exits the coin dispensing device 10. The coin actuator 70 has a small bearing 72 on the end of the outer arm 71 which engages each coin exiting the coin dispensing device 10. The coin actuator 70 is used to count the number of loose coins that have been dispensed.

Figure 3:
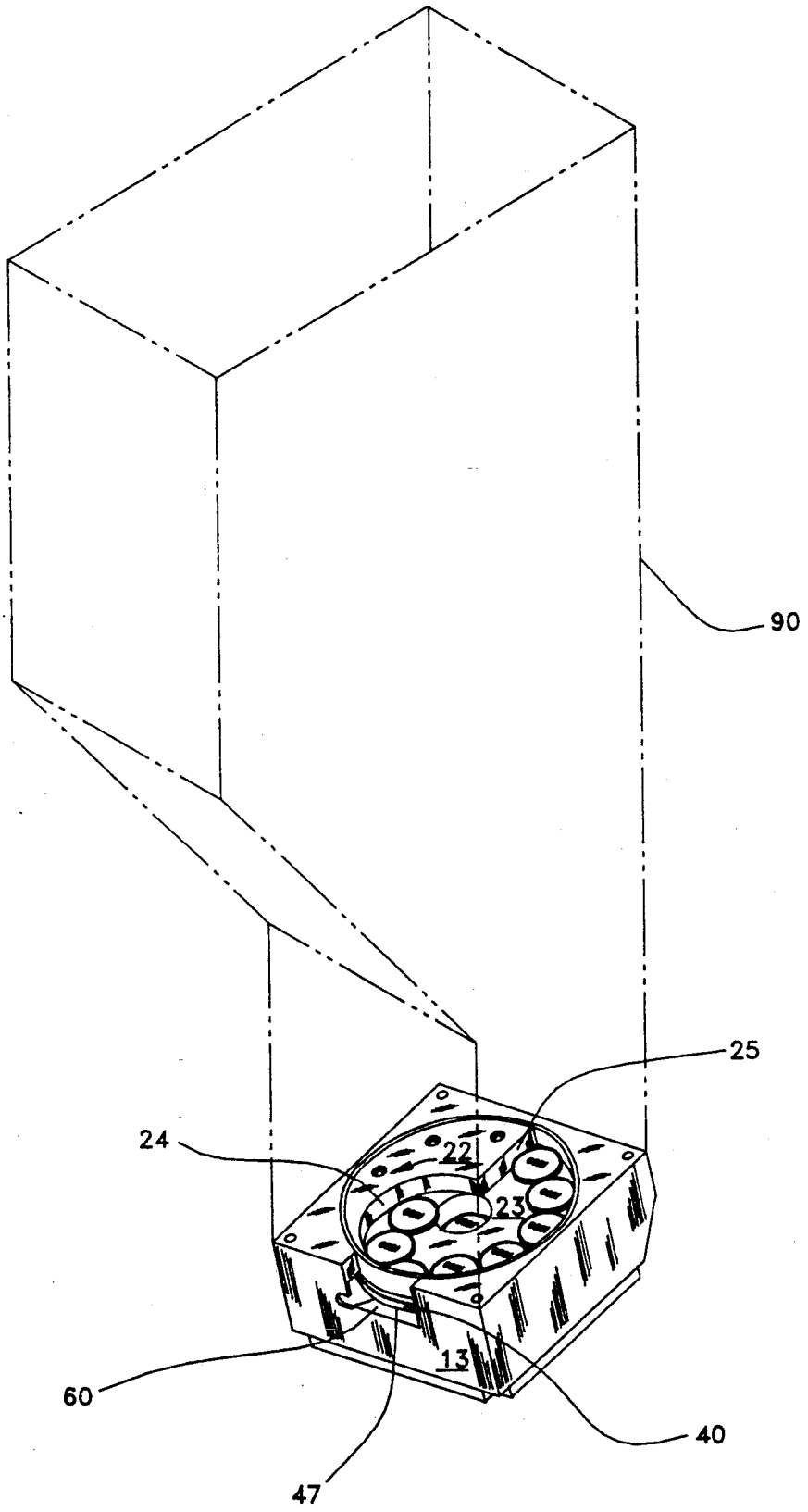
FIG. 3 shows a perspective view of the coin dispensing device of the present invention mounted under a coin hopper (in phantom) that stores loose coins for dispensing.

As shown in FIG. 3, the coin dispensing device 10 is disposed on the bottom of a coin hopper 90. The number of coins that can be stored in the coin hopper is simply dependent on the size of the cavity inside the coin hopper and is not dependent on the manner in which the coin dispensing device 10 operates. The coin dispensing device 10 may be disposed in a horizontal orientation inside the coin dispensing device in which it is to be used. Alternatively, the coin dispensing device 10 can be tipped slightly forward, at an angle of approximately 30° below horizontal as shown in FIG. 3, so that the coins receive better mixing.

The weight of the coins in the coin hopper is held by the first rotating disk 20. The weight of the coins is not supported by the second rotating disk 50, the dispensing slot 46 or the exit slot 60 so that these elements can properly function independently of the number of coins in the coin hopper. The weight of the coins is not detrimental to the functioning of the second rotating disk 50, the dispensing slot 46 or the exit slot 60 and causes no wear or tear on these elements.

Figure 4:
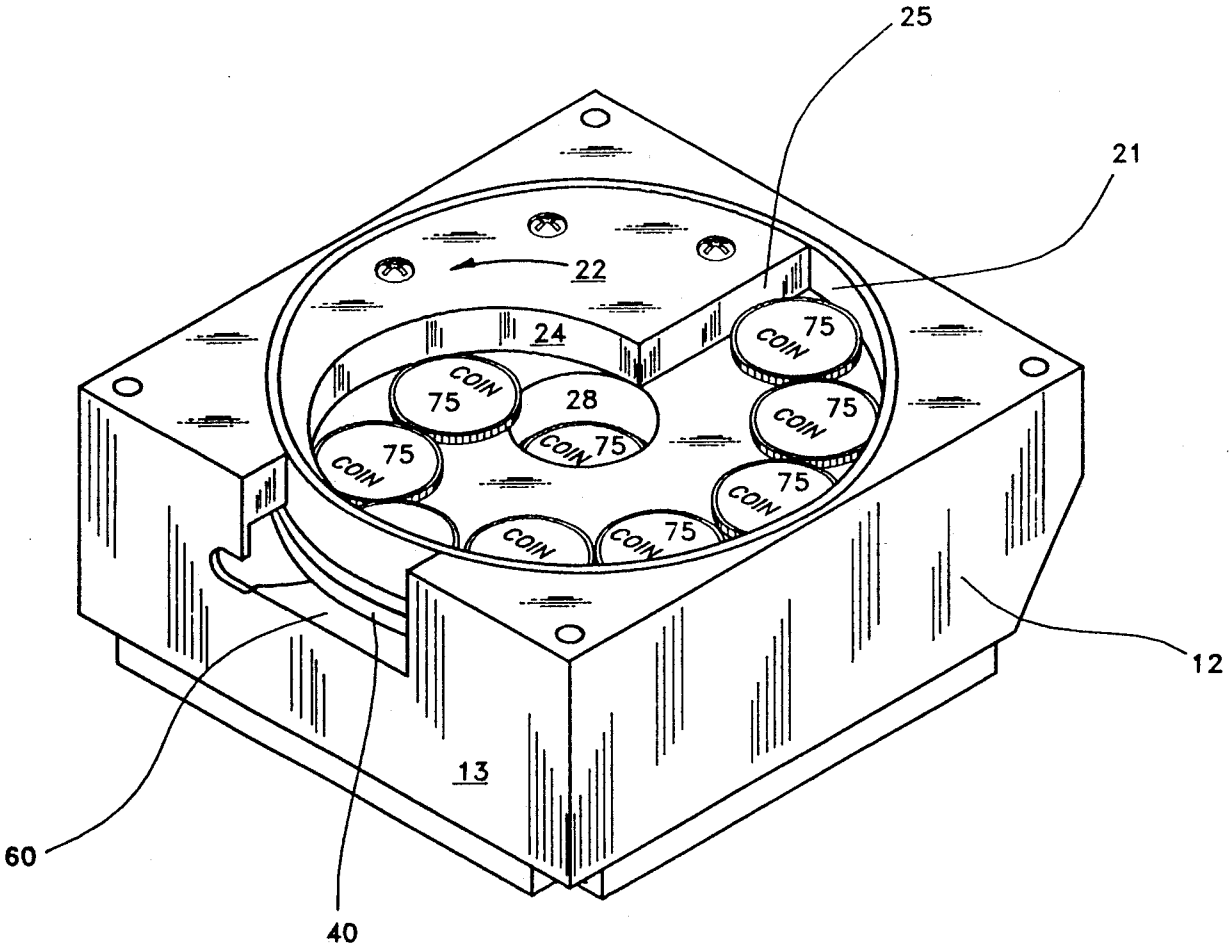
FIG. 4 shows a perspective view of the coin dispensing device of the present invention with coins sitting on the first rotating, disk.

The operation of the coin dispensing device 10 can be explained in connection with FIGS. 4, 5 and 6. Considering FIG. 4, a plurality of coins 75 from the coin hopper 90 fall onto the bottom plate 23 of the first rotating disk 20. The first rotating disk 20 rotates in a counterclockwise direction (as shown by the arrow in FIG. 4) which agitates the coins in the hopper 90 and causes coins 75 to be swept by the feeding member 22 into the central feed aperture 28 of the first rotating disk 20. This sweeping action is effected by the arcuate sidewall 24 on the feeding member 22. Since the arcuate sidewall 24 extends from the side wall 21 right up to the central feed aperture 28, no coins will be able to escape the sweeping action of the feeding member 22.

Figure 5:
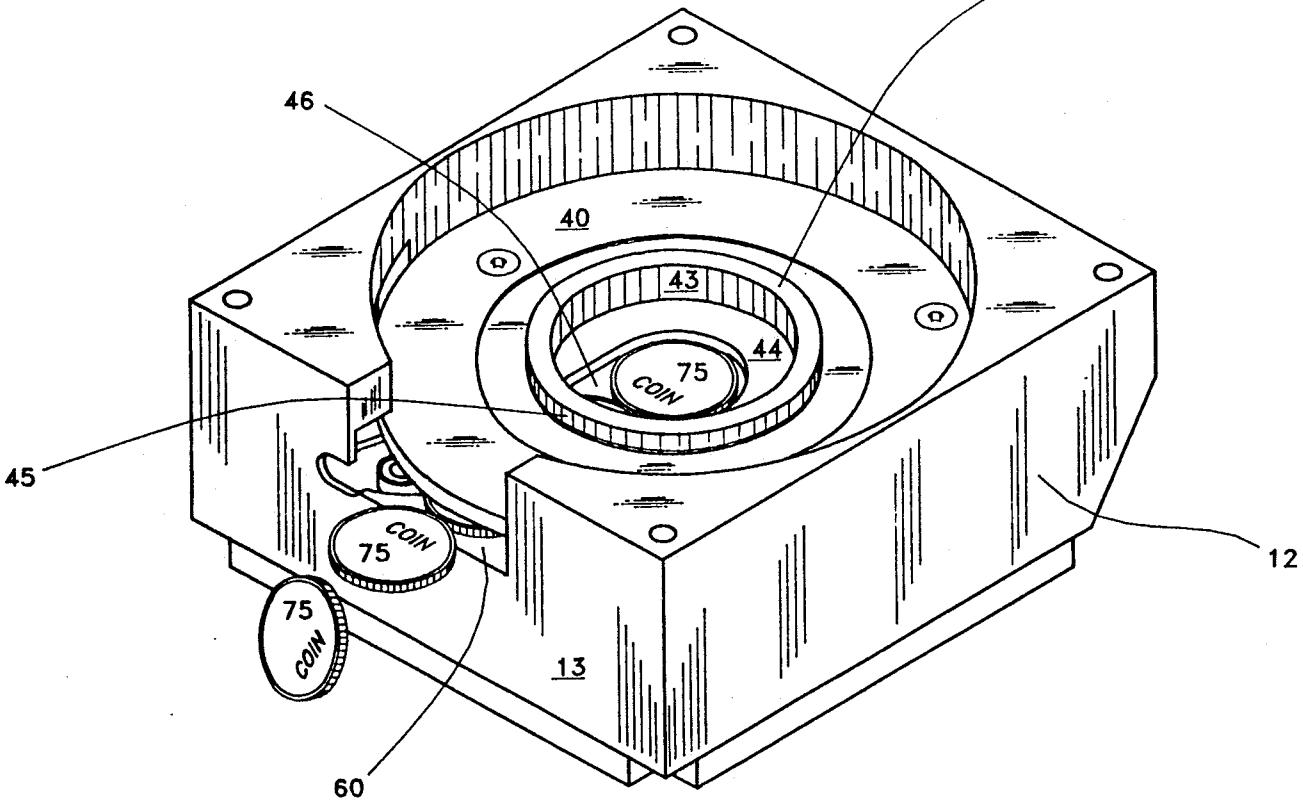
FIG. 5 shows a perspective view of the coin dispensing device of the present invention with the first rotating disk removed and coins sitting in the dispensing slot of the fixed disk ready for dispensing.

Next FIG. 5 shows the base plate 12 with the first rotating disk 20, the upper thrust bearing runner 32, the thrust bearing 34 and the lower thrust bearing runner 36 removed for clarity. As the coins 75 fall through the central feed aperture 28 of the first rotating disk 20, each coin ends up in the dispensing slot 46 defined by the dispensing slot plate 44. The underside of each coin 75 lies partly on the surface of the upper cavity 16 and partly on the top surface of the second rotating dispensing disk 50 as shown more clearly in FIG. 6.

The dispensing slot 46 has an arcuate area at the inside end having a diameter approximately the diameter of a coin 75 to be fed which assists in the proper alignment of the coins 75. The dispensing slot 46 is a continuous slot in the bottom of the fixed disk 40, the continuous slot opening to the exit slot 60 on the front side 13 of the base plate 12. This arrangement allows the coins 75 to line up in a row in the dispensing slot 46 as shown in FIG. 5.

Figure 6:
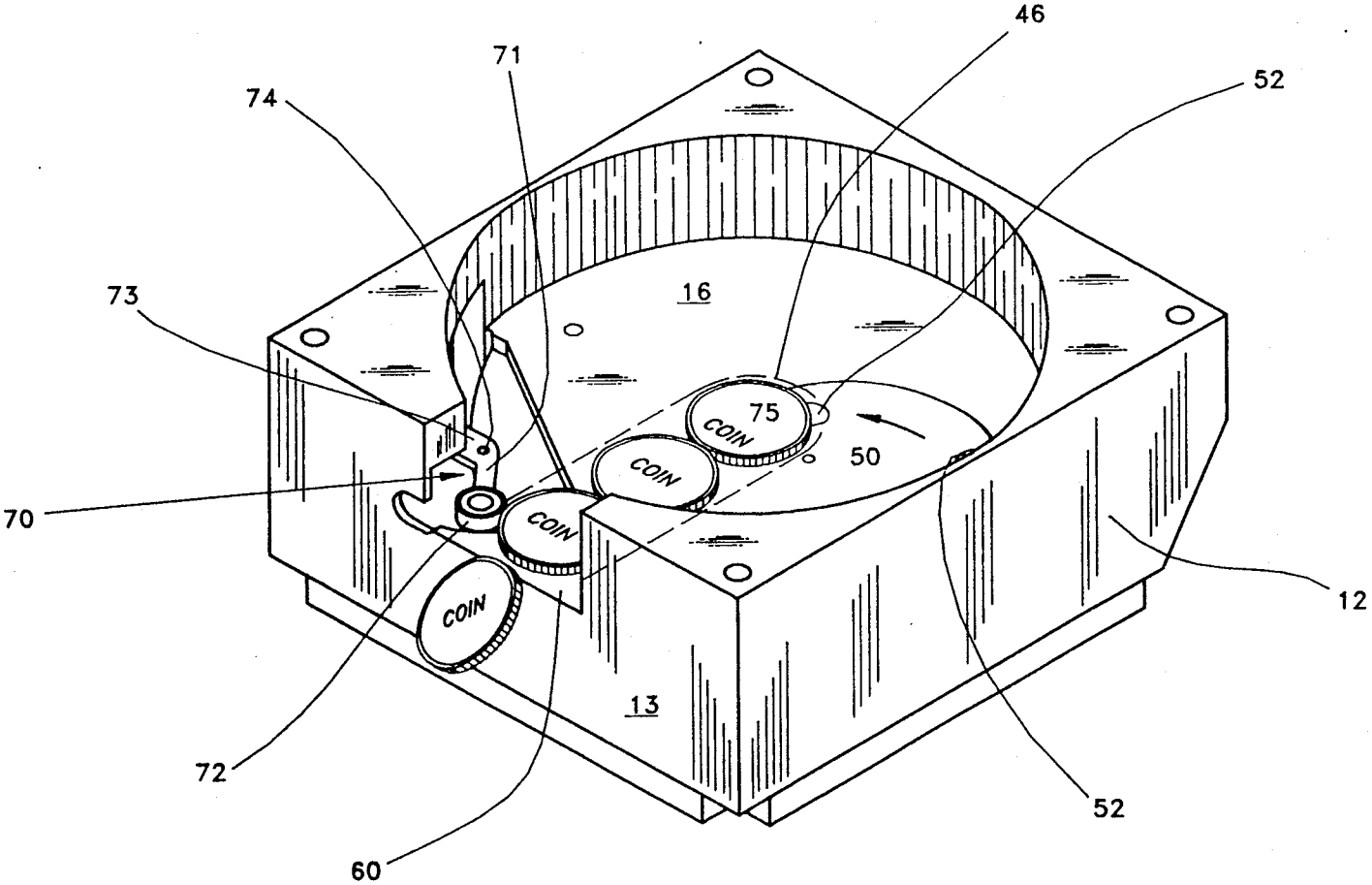
FIG. 6 shows a perspective view of the coin dispensing device of the present invention with the first rotating disk and the fixed disk removed and the second rotating disk acting to dispense coins through the exit slot.

FIG. 6 shows the coin dispensing device 10 with the fixed disk 40 removed for clarity. The coins 75 are lined up in the location where the dispensing slot 46 (shown in phantom) would be. The second rotating dispensing disk 50 is positioned in the lower disk cavity 14 in the base plate 12 in an offset orientation to the fixed disk 40. As the second rotating disk 50 rotates about its disk shaft 53, the outer periphery of the second rotating disk 50 moves counterclockwise (as shown by the arrow in FIG. 6) and underneath the row of coins. A pusher ball 52 on the peripheral edge of the second rotating disk 50 comes into contact with the edge of a coin 75 at the inside end of the row of coins. The pusher ball 52 pushes on the edge of the coin 75 causing the coin 75 to be urged along the dispensing slot 46 which effects the coin 75 closest to the exit slot 60 in the front side 13 to be pushed out of the coin dispensing device 10. The coin 75 pushed out falls into a coin tray (not shown) where the coin 75 is accessible to a patron.

In the preferred embodiment for coins of the size of U.S. nickels or quarters, the second rotating disk 50 is provided with three pusher balls 52 arranged equally spaced around the periphery of the second rotating disk 50. As the second rotating disk 50 rotates, each of the pusher balls 52 will push one coin 75 along the row to dispense a coins 75 into the adjacent coin tray. In the preferred embodiment for coins of the size of U.S. dollars or half dollars, the second rotating disk 50 is provided with two pusher balls 52 diametrically spaced around the periphery of the second rotating disk 50.

As the second rotating disk 50 rotates, each pusher ball 52 in turn comes into contact with the edge of a coin 75 lined up in the dispensing slot 46. The pusher ball 52 will provide a positive drive to the edge of a coin 75 only up to a certain force which is determined by the strength of the bias spring 56 and the torque of the motor driving the second rotating disk 50. If the force necessary to push the coin exceeds a certain level (which would occur in the event of a coin jam), the pusher ball 52 will push down on the bias spring 56 and slide underneath the edge of the coin 75.

Also as shown in FIG. 6, as each coin 75 exits through the exit slot 60, the movement of the coin 75 pushes on the small bearing 72 to trip the coin actuator 70. Each trip of the coin actuator 70 causes the coin actuator 70 to pivot around pivot pin 74 causing the inner arm 73 to pass through a conventional sensing device (not shown), such as an optical or light beam sensor. The sensing device sends a signal to an electronic control system to count a coin 75 as being dispensed. Pivot pin is biased to return the coin actuator 70 to its inward position (shown in FIG. 2) as each coin 75 passes by so that the coin actuator will be ready to count the next coin.

FIG. 7 shows in detail the internal gearing of the coin dispensing device 10 which effects the rotation of the first rotating disk 20 and the second rotating disk 50 so that the disks rotate simultaneously. A drive gear shaft 68 is accessible through the bottom of the base plate 12 so that the lower end of the drive gear shaft can be connected to a motor (not shown). Along the length of the drive gear shaft 68 there is provided a transfer gear 66 that interacts with the gear teeth 57 on the second rotating disk 50. The second rotating disk has a disk shaft 53 that also is accessible through the bottom of the base plate 12.

The upper end of the drive gear shaft 68 is a generally circular mounting post 64 that extends through an aperture in the upper cavity 16. The top of the mounting post 64 has a polygonal cross section to receive the drive gear 62 mounted thereon. The drive gear 62 has teeth on in its peripheral edge which interact with gear teeth 29 on the underside inside surface of the first rotating gear 20.

When the motor is actuated to dispense coins from the device, the motor causes drive gear shaft 68 to rotate. The rotation of drive gear shaft 68, through transfer gear 66 and gear teeth 57, causes the second rotating disk 50 to rotate and dispense coins as described above. The rotation of drive gear shaft 68 simultaneously causes rotation of the first rotating disk 20 through drive gear 62 interacting with the gear teeth 29 on the underside inside surface of the second rotating disk 20.

Because of the design of the coin dispensing device 10, coins 75 will only be dispensed when the first rotating disk 20 and the second rotating disk 50 are rotated in a counterclockwise direction. This feature allows a clockwise rotation of the first rotating disk 20 and the second rotating disk 50 to be used to clear any coin jams that may occur.

If coins bridge in the bottom of the coin hopper 90, a reversal of the motor will cause the first rotating disk 20 to rotate in a clockwise direction. The flat end wall 25 on the feeding member 22 will push against the bridged coins and free up the coins for dispensing.

Similarly, if coins jam in the central feed aperture which would be caused by the coins falling through the central feed aperture 28 at an angle instead of horizontally, a reversal of the motor will cause the second rotating disk 50 to rotate in a clockwise direction to alleviate any pressure causing the coin jam and allow the coins to rearrange themselves for dispensing. Since the pusher balls 52 are mounted on bias springs 56, the pusher balls 52 will be able to withdraw into the apertures holding the bias springs 56 to allow movement of the jammed coins 75.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A coin dispensing device for dispensing loose coins from a coin hopper comprising:

a) a base plate, b) a first rotating disk mounted on the base plate, the first rotating disk having a central feed aperture, c) a fixed disk mounted to the base plate and beneath the first rotating disk, the fixed disk having a dispensing slot aligned with the central feed aperture, d) a second rotating disk mounted on the base plate and beneath the fixed disk, the second disk offset from the dispensing slot, and e) the second rotating disk including at least one pusher ball on the surface thereof cooperating with the dispensing slot whereby loose coins from the coin hopper are fed into the central feed aperture of the first rotating disk, from which the coins fall into the dispensing slot in the fixed disk and are dispensed down the dispensing slot by the movement of the pusher ball on the second rotating disk and exit the coin dispensing device.

2. The coin dispensing device of claim 1 wherein the base plate comprises a generally rectangular body having an upper cavity in which the first rotating disk is mounted and a lower cavity in which the second rotating disk is mounted.

3. The coin dispensing device of claim 2 wherein the fixed disk is also mounted in the upper cavity.

4. The coin dispensing device of claim 1 wherein the base plate includes an exit slot cooperating with the dispensing slot whereby coins to be dispensed are fed out of the exit slot of the coin dispensing device.

5. The coin dispensing device of claim 4 further including a coin actuator positioned adjacent the exit slot whereby coins can be counted as they are dispensed.

6. The coin dispensing device of claim 5 wherein the coin actuator is pivotally mounted to the base plate and comprises an outer arm that engages a coin being dispensed and an inner arm that interacts with a sensing device whereby as the coin is dispensed the coin actuator is caused to pivot so that the sensing device counts the coin as dispensed.

7. The coin dispensing device of claim 1 wherein the first rotating disk includes a feeding member that engages coins to be dispensed and feeds each coin into the central feed aperture.

8. The coin dispensing device of claim 7 wherein the feeding member includes an arcuate sidewall that extends from the periphery of the first rotating disk to the central feed aperture whereby coins to be dispensed are engaged by the arcuate sidewall and fed into the central feeding aperture.

9. The coin dispensing device of claim 8 wherein the feeding member further includes a flat end wall that extends from the periphery of the first rotating disk to the central feed aperture whereby in the event that coins jam on the first rotating disk, the flat end wall can be rotated to dislodge the bridged coins.

10. The coin dispensing device of claim 1 wherein at least one thrust bearing is interposed between the first rotating disk and the fixed disk to permit the first rotating disk to move relative to the fixed disk.

11. The coin dispensing device of claim 1 wherein an upper thrust bearing runner, a thrust bearing and a lower thrust bearing runner are interposed between the first rotating disk and the fixed disk to permit the first rotating disk to move relative to the fixed disk.

12. The coin dispensing device of claim 1 wherein the pusher ball is located at the approximate periphery of the second rotating disk.

13. The coin dispensing device of claim 1 wherein the pusher ball is mounted in an aperture in the second rotating disk and spring biased upwardly from the surface of the second rotating disk so that the pusher ball can withdraw into the aperture and move underneath a jammed coin.

14. The coin dispensing device of claim 13 wherein three pusher balls are provided equally spaced around the periphery of the second rotating disk.

15. The coin dispensing device of claim 1 wherein a drive gear shaft is mounted in the base plate, the first rotating disk is connected to the drive gear shaft and the second rotating disk is connected to the drive gear shaft so that the first and second rotating disks are each rotated simultaneously by activation of the drive gear shaft.

16. The coin dispensing device of claim 15 wherein the drive gear shaft includes a drive gear mounted thereon that interacts with gear teeth on a lower inside surface of the first rotating disk so that rotation of the drive gear shaft effects rotation of the first rotating disk.

17. The coin dispensing device of claim 15 wherein the drive gear shaft includes a transfer gear mounted thereon that interacts with gear teeth on the second rotating disk so that rotation of the drive gear shaft effects rotation of the second rotating disk.

18. A coin dispensing device for dispensing loose coins from a coin hopper comprising:

a) a base plate comprising a generally rectangular body having an upper cavity and a disk cavity, b) a first rotating disk mounted in the upper cavity of the base plate, the first rotating disk having a central feed aperture, the first rotating disk further including a feeding member that engages coins to be dispensed and feeds each coin into the central feed aperture, c) a fixed disk mounted in the upper cavity of the base plate and beneath the first rotating disk, the fixed disk having a dispensing slot aligned with the central feed aperture, d) a second rotating disk mounted in the lower cavity of the base plate and beneath the fixed disk, the second disk offset from the dispensing slot, and e) the second rotating disk including at least one pusher ball on the surface thereof cooperating with the dispensing slot whereby loose coins from the coin hopper are fed into the central feed aperture of the first rotating disk, from which the coins fall into the dispensing slot in the fixed disk and are dispensed down the dispensing slot by the movement of the second rotating disk and exit the coin dispensing device.

19. The coin dispensing device of claim 18 wherein the base plate includes an exit slot cooperating with the dispensing slot whereby coins to be dispensed are fed out of the exit slot of the coin dispensing device.

20. The coin dispensing device of claim 19 further including a coin actuator positioned adjacent the exit slot whereby coins can be counted as they are dispensed.

21. The coin dispensing device of claim 20 wherein the coin actuator is pivotally mounted to the base plate and comprises an outer arm that engages a coin being dispensed and an inner arm that interacts with a sensing device whereby as the coin is dispensed the coin actuator is caused to pivot so that the sensing device counts the coin as dispensed.

22. The coin dispensing device of claim 18 wherein the feeding member includes an arcuate sidewall that extends from the periphery of the first rotating disk to the central feed aperture.

23. The coin dispensing device of claim 18 wherein at least one thrust bearing is interposed between the first rotating disk and the fixed disk to permit, the first rotating disk to move relative to the fixed disk.

24. The coin dispensing device of claim 18 wherein an upper thrust bearing runner, a thrust bearing and a lower thrust bearing runner are interposed between the first rotating disk and the fixed disk to permit the first rotating disk to move relative to the fixed disk.

25. The coin dispensing device of claim 18 wherein the pusher ball is located at the approximate periphery of the second rotating disk.

26. The coin dispensing device of claim 25 wherein three pusher balls are provided equally spaced around the periphery of the second rotating disk.

27. The coin dispensing device of claim 18 wherein a drive gear shaft is mounted in the base plate, the first rotating disk is connected to the drive gear shaft and the second rotating disk is connected to the drive gear shaft so that the first and second rotating disks are each rotated simultaneously by activation of the drive gear shaft.

28. The coin dispensing device of claim 27 wherein the drive gear shaft includes a drive gear mounted thereon that interacts with gear teeth on a lower inside surface of the first rotating disk so that rotation of the drive gear shaft effects rotation of the first rotating disk.

29. The coin dispensing device of claim 27 wherein the drive gear shaft includes a transfer gear mounted thereon that interacts with gear teeth on the second rotating disk so that rotation of the drive gear shaft effects rotation of the second rotating disk.

30. A coin dispensing apparatus for dispensing loose coins comprising:

a) a coin hopper having a bottom coin opening, and b) a coin dispensing device mounted to the bottom coin opening of the coin hopper, the coin dispensing device comprising:

1) a base plate, 2) a first rotating disk mounted on the base plate, the first rotating disk having a central feed aperture, 3) a fixed disk mounted to the base plate and beneath the first rotating disk, the fixed disk having a dispensing slot aligned with the central feed aperture, 4) a second rotating disk mounted on the base plate and beneath the fixed disk, the second disk offset from the dispensing slot, and 5) the second rotating disk including at least one pusher ball on the surface thereof cooperating with the dispensing slot whereby loose coins from the coin hopper are fed into the central feed aperture of the first rotating disk, from which the coins fall into the dispensing slot in the fixed disk and are dispensed down the dispensing slot by the movement of the second rotating disk and exit the coin dispensing device.

* * * * *